US005890587A

United States Patent [19]

Roegner

[11] Patent Number: 5,890,587

[45] Date of Patent: Apr. 6, 1999

[54] JEWELRY CASE

[76] Inventor: DeAnna Roegner, 774 Mays Blvd., #10-405, Incline Village, Nev. 89451

[21] Appl. No.: 64,963

[22] Filed: Apr. 23, 1998

[51] Int. Cl.[6] ..... A45C 11/04

[52] U.S. Cl. ..... 206/6.1; 211/85.2

[58] Field of Search ..... 206/6.1, 495, 566; 383/39, 40; 211/85.2; 190/102

[56] References Cited

U.S. PATENT DOCUMENTS

| | | | |
|---|---|---|---|
| 4,720,012 | 1/1988 | Dufour | 206/495 |
| 4,760,920 | 8/1988 | Thomsen | 206/495 |
| 4,848,562 | 7/1989 | Liu | 206/6.1 |
| 5,779,033 | 7/1998 | Roegner | 206/6.1 |

*Primary Examiner*—David T. Fidei
*Attorney, Agent, or Firm*—Baker & Maxham

[57] ABSTRACT

A jewelry case, comprises a primary shell of pliable material, said shell formed of a substantially rectangular primary panel having an inner face and an outer face and foldable along a pair of lines transverse of the back panel forming a top panel section, an intermediate panel section and a bottom panel section, and wherein each panel section has a pocket assembly having at least one pocket with a transparent front panel, a first jewelry mounting panel having a plurality of button hole slits formed therein for detachably mounting a plurality of clip style ear rings, the first mounting panel pivotally secured along one edge to the shell at the juncture of said top panel section, and the intermediate panel section, a second ear ring mounting panel secured along one edge to the primary shell at the juncture of the intermediate panel section and the bottom panel section, the panel having a mesh construction, and button hole slits for mounting clip style ear rings, and at least a partially transparent closure panel pivotally secured along one edge to the shell at each side of each of the mounting panels for covering the mounting panel and the closure panels releasably securable along three sides over the mounting panel.

20 Claims, 3 Drawing Sheets

JEWELRY CASE

REFERENCE TO RELATED APPLICATION

The present application is related to application Ser. No. 08/821,420 entitled "JEWELRY CARRYING CASE", filed Mar. 21, 1997, now U.S. Pat. No. 5,779,033.

BACKGROUND OF THE INVENTION

The present invention relates to carrying cases and pertains particularly to an improved jewelry carrying case having an improved arrangement of multiple pockets and mounting panels for organizing and carrying multiple articles of jewelry in a convenient fashion.

Many ladies have many items of jewelry which they often long when traveling. These many items of jewelry are often all placed in a single pouch or loosely in a purse or suitcase. This often leaves the items disorganized, sometimes tangled and often makes it difficult to easily locate and match mating pairs.

Many of these problems were solved to a great extent by the aforementioned application which has been allowed. However, applicant has discovered that the jewelry bag and organizer of that patent is in need of some improvement in many areas. For example, it could use a more effective and secure earring containing section. It could use more sections for separating large and small pieces of jewelry. In addition more effective security for the jewelry pieces is desirable.

Accordingly, there is a need for an improved jewelry case that is more effective and secure in organizing, holding and carrying many different related or unrelated items of jewelry in an organized fashion. It would also be desirable to have a case with multiple different size pockets with holders for holding many different sets of related articles for ease of location and retrieval.

SUMMARY AND OBJECTS OF THE INVENTION

It is the primary object of the present invention to provide an improved jewelry case with multiple pockets and attachment means for holding articles of different sizes secure and readily accessible in an organized arrangement.

A jewelry carrying case comprises a primary shell of pliable material, said shell formed of a substantially rectangular primary panel having an inner face and an outer face and foldable along selected lines transverse of the back panel forming a primary receptacle, at least a first ear ring mounting panel secured along one edge to said primary shell, said panel having a mesh construction, a pair of cover panels, each secured along one edge to said shell and securable to each other along an edge for enclosing said ear ring mounting panel, at least one of said cover panels being transparent, and at least a first pocket assembly secured to said inner face of said primary panel inside said primary shell, said pocket assembly comprising a front pocket panel secured along at least a bottom edge and side edges to said primary panel for forming a pocket.

BRIEF DESCRIPTION OF THE PREFERRED EMBODIMENT

The above and other objects and advantages of the present invention will become apparent from the following description when read in conjunction with the accompanying drawings wherein.

DETAILED DESCRIPTION OF THE PREFERRED EMBODIMENTS

Figure 3:
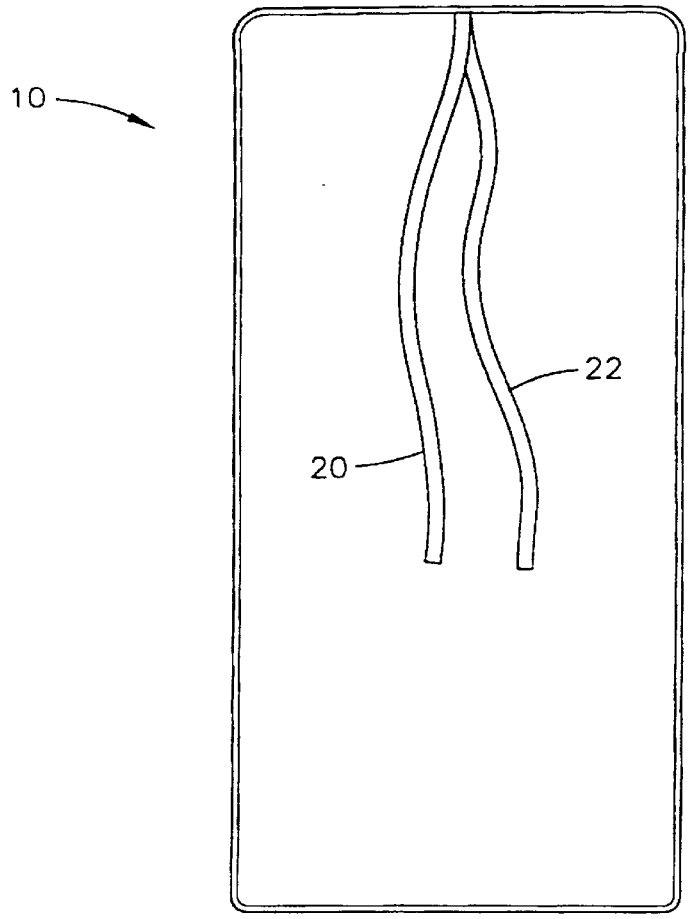
FIG. 3 is a back elevation view of the embodiment FIG. 1.
Figure 4:
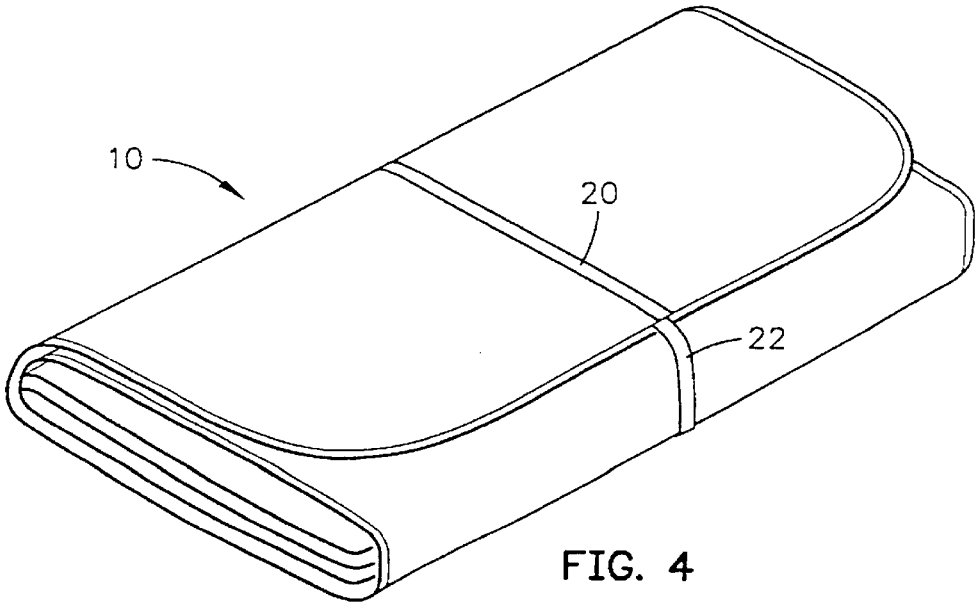
FIG. 4 is a perspective view of the invention showing the case in the closed position.

Referring to FIGS. 1–4 of the drawings, the carrying case in accordance with the invention is illustrated and designated generally by the numeral 10. The case is preferably constructed of a pliable material, such as leather, vinyl, or any of the suitable woven materials, now widely used for hand bags, carrying cases and the like. The case comprises a primary support and closure panel shell formed of a unitary elongated substantially rectangular panel having an inner face 12 and an outer face 14, and foldable along multiple transverse lines forming a primary carrying case or receptacle, as illustrated in FIG. 4.

Figure 1:
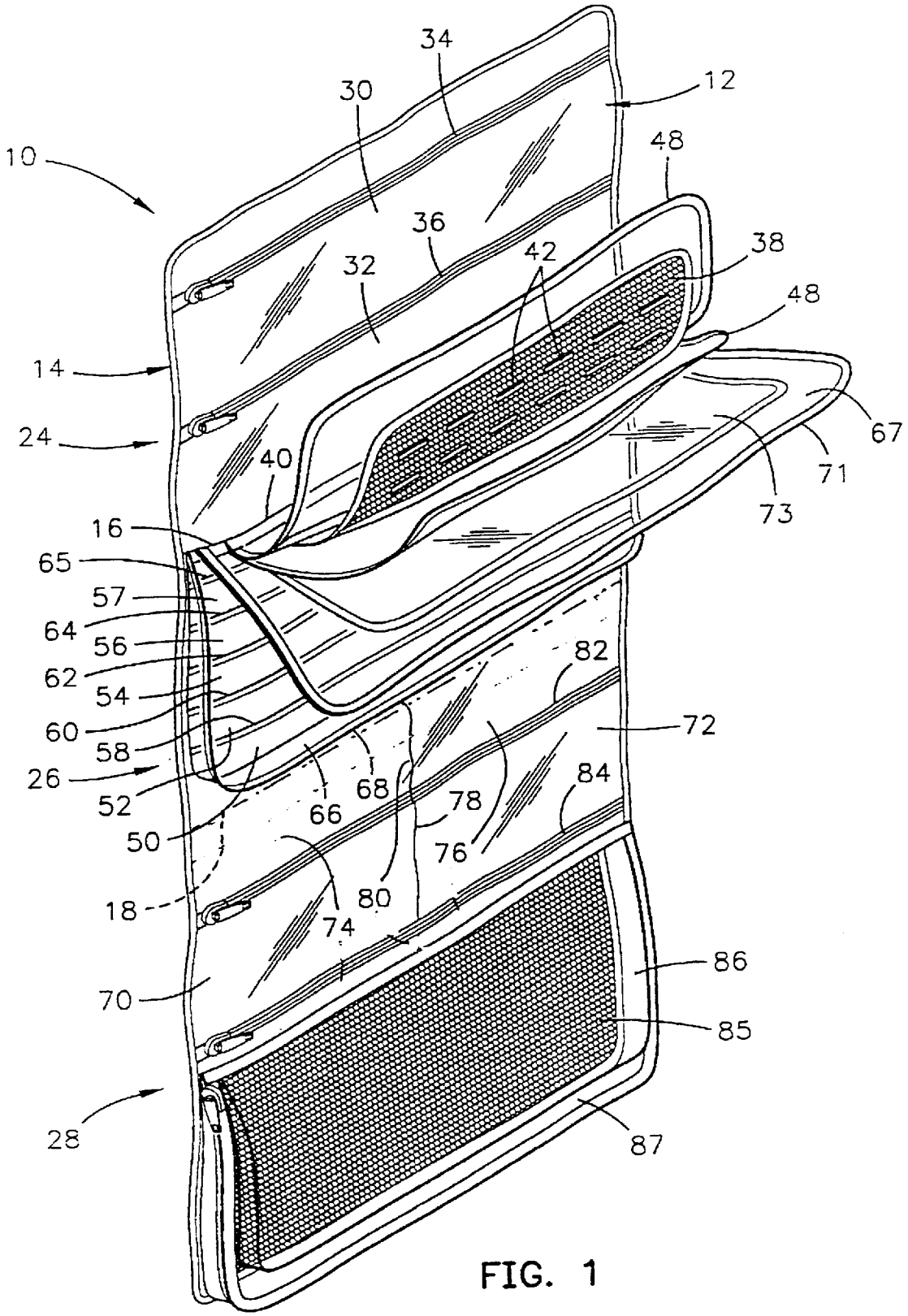
FIG. 1 is a front perspective elevation view of exemplary embodiment of the invention with the case fully open with a mounting panel and cover panels open to show details.
Figure 2:
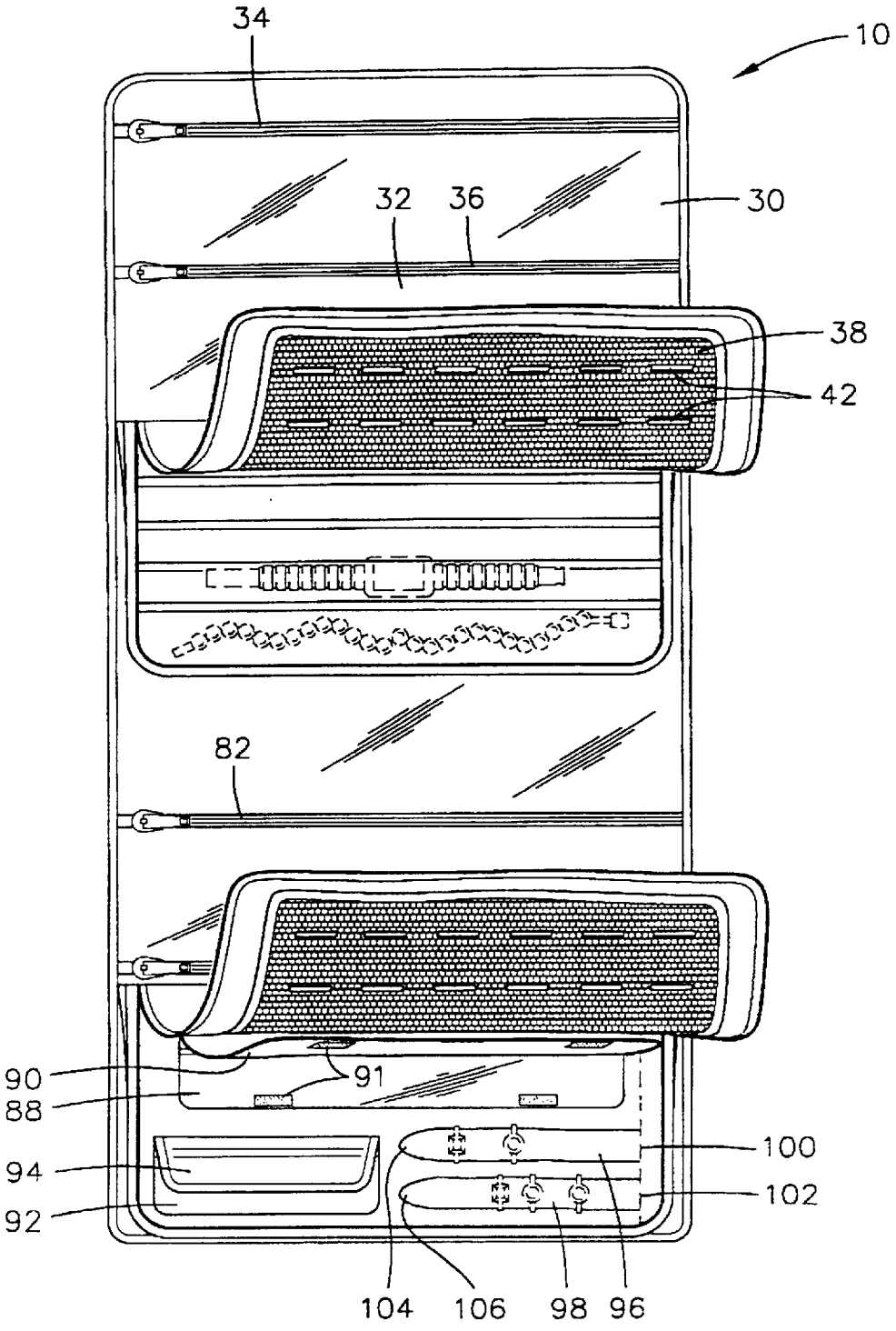
FIG. 2 is a front view like FIG. 1 with ring mounting panels pivoted away to reveal underlying pocket assemblies.

Referring to FIG. 1 of the drawing, the jewelry organizer and protective storage case or bag in accordance with the invention comprises a primary shell or back panel of a pliable material formed of a substantially rectangular primary panel having an inner surface and an outer surface or face and foldable along selected transverse lines including at 16 and 18 thereby forming four sections. The case is foldable along the lines between the sections into a closed receptacle and may be secured in the folded or closed position or condition by any suitable means, such as a pair of straps or cords 20 and 22 (FIGS. 3 and 4). The straps or cords 20 and 22 are secured at what may be preferably the top of the case.

The case, as previously mentioned may be made out of any suitable pliable material, such as leather, vinyl or any of the durable fabrics typically used for handbags and luggage. The case may be divided, as in the illustrated embodiment, into four primary sections starting at the top into a top panel section 24 an upper and lower intermediate or center panel section 26 and a bottom panel section 28.

In the illustrated arrangement the top or upper panel section 24 is provided with two pockets 30 and 32, each having an opening slit provided with preferably a zipper closure 34 and 36. Each of these pockets or envelopes is formed in the usual manner with a front panel secured along bottom and side edges by a suitable means such as sewing or gluing to the back panel. It is formed preferably with a transparent front or face panel. This enables the user to view the contents of the respective pocket. These pockets extend the full width of the primary shell and are to hold primarily necklaces, particularly of the longer, stiffer chain type.

Pivotally attached across the primary shell approximately the fold line or area 16 is a large rectangular earring panel 38 which is secured along one edge transverse to the primary shell. This panel is formed of a mesh-like material to receive pairs of post-style earrings throughout the area of the panel. The panel is also provided with a plurality of button hole slits 42 for receiving and mounting pairs of clip-style earrings. The slits are formed like button holes with reinforcing threads sewn around the edges of the slits. The clips of the earrings extend through the slits and clamp to the opposing surfaces of the panel adjacent the slit.

The ring mounting panel is protectively enclosed by means of a pair of panels 44 and 46 at least one of which is a transparent panel to enable viewing the contents mounted on the panel. The cover panels are secured to each side of the edge of the panel 38 and are each provided with zipper closure means at 48 extending around three sides of the panels to fully enclose the earring mounting panel 38. These panels protectively enclose the earring mounting panel, and protectively secure the earrings.

The central panel section 26 is formed on its upper section inner face with a plurality of envelope type slit pockets 50, 52, 54, 56 and 57, each of which overlaps a portion of the preceding upper panel. Thus, the pockets preferably have different depths depending upon the degree of overlap with the top pocket having the greatest depth. These pockets are formed by securing a front panel along bottom and side edges to the back panel. The front panels of each of these pockets is preferably formed of a transparent material so that the contents of the pocket may be easily viewed. These pockets may be advantageously used for holding necklaces, bracelets and the like. The pockets each have openings 58, 60, 62, 64 and 65, respectively, which may have zipper type closures. However, in the illustrated embodiment the openings of the pockets are illustrated as having an adjacent reinforcing fabric strip along the edges thereof.

A protective closure for these pockets include transparent cover panel 67 which covers the overlapping pocket assembly and is secured along an upper edge transverse to the primary shell and is releasably secured by suitable fastening means, such as a zipper closure 71 to a zipper closure 68 to an upstanding lip 66 along its edge over the pockets 50–57. This protectively encloses the pockets to secure any jewelry therein in place. A cover panel 73 below cover panel 67 overlies the pockets. The upper panel 67 secures along its edge 71 to the zipper edge 68 of upstanding wall panel 66 and protectively encloses the pocket assembly.

The lower or bottom central section panel 28 is formed with pockets 70, 72, 74 and 76. These pockets are formed like the pockets on the top panel but are divided along vertical lines at 78 and 80 to form four pockets rather than two as in the previous pocket assembly. A closure in the form of a zipper 82 and 84 is provided for each of the pairs of pockets.

The lower or bottom panel is provided with an earring mounting pocket assembly substantially like the previously described one. It has a mounting panel 85 covered by closure panels 86 with zipper 87. However, this earring mounting assembly overlies a pocket assembly of a different construction.

An upper pocket 88 is mounted on the lower section of the cover panel and has a closure flap 90. This pocket traverses the entire width of the primary shell and as in previous pockets, preferably formed of a front panel being transparent. The cover panel 90 may also preferably be transparent. In addition, the panel may have securing means such as Velcro patches 91 or the like to secure the closure in its closed position. This pocket can conveniently hold long necklaces and the like.

A second pocket 92 similar to the previous pocket but of less width, is also provided and also preferably has a closure flap 94. The pocket 88 is suitable for necklaces and the like and the pocket 92 suitable for bracelets and the like.

A ring mounting assembly is also provided in the form of a pair of ring studs 96 and 98 on the lower panel at the lower right hand corner. These are each preferably formed of a cylindrical stuffed sleeve, each secured respectively along a right end by stitching or the like to the back panel at 100 and 102. The opposite ends of each of the studs is preferably provided with releasable fastening means at 104 and 106, which is preferably in the form of Velcro fastening means (not shown). These studs may be sized to the finger of the particular individual whose rings are in the case.

In operation, the organizing and storage case may be filled with a large number of items of jewelry and the various compartments and sections thereof secured to provide secure storage of the items of jewelry. The case may be folded along the multiple fold lines and tied by the securing straps 20 and 22 into a conveniently compact unit. This unit may be conveniently placed in a purse or a small suitcase or other carrying bag for transport of and easy access to the contents of the case.

While I have illustrated and described my invention by means of specific embodiments, it is to be understood that numerous changes and modifications may be made therein without departing from the spirit and the scope of the invention as shown in the appended claims.

I claim:

1. A jewelry carrying case, comprising:

a primary shell of pliable material, said shell formed of a substantially rectangular primary panel having an inner face and an outer face and foldable along selected lines transverse of the back panel forming a primary receptacle;

at least a first ear ring mounting panel secured along one edge to said primary shell, said panel having a mesh construction;

a pair of cover panels, each secured along one edge to said shell and securable to each other along an edge for enclosing said ear ring mounting panel, at least one of said cover panels being transparent; and at least a first pocket assembly secured to said inner face of said primary panel inside said primary shell, said pocket comprising a front pocket panel secured along at least a bottom edge and side edges to said primary panel for forming a pocket.

2. The carrying case of claim 1 wherein at least said front pocket panel is transparent.

3. The carrying case of claim 1 wherein said pocket assembly includes a closure panel and said closure panel is at least partially transparent.

4. The carrying case of claim 1 wherein said pocket assembly includes a plurality of overlapping pockets, and a cover panel for covering said pockets.

5. The carrying case of claim 4 wherein said first ear ring mounting panel overlies said pocket assembly.

6. The carrying case of claim 5 wherein said pocket assembly includes a transparent cover panel releasably securable by a zipper.

7. The carrying case of claim 1 wherein said ear ring mounting panel comprises a plurality of button hole slits adapted to mount a plurality of clip style ear rings.

8. The carrying case of claim 7 wherein said primary panel is foldable along a pair of lines transverse of the back panel forming a top panel section, an intermediate panel section and a bottom panel section, and wherein each panel section has a pocket assembly.

9. The carrying case of claim 8 wherein said first ear ring panel covers a pocket assembly on said intermediate panel section.

10. The carrying case of claim 9 comprising a second ear ring panel normally covering a pocket assembly on said bottom panel section.

11. The carrying case of claim 10 further comprising at least one ring bar for mounting a plurality of rings on one of said panel sections.

12. The carrying case of claim 11 wherein one of said panel sections comprises a pocket assembly having a plurality of overlapping pockets, and a cover panel for covering said pockets.

13. The carrying case of claim 12 wherein said plurality of overlapping pockets are on said intermediate panel section.

14. The carrying case of claim 12 wherein said ring bar is on said bottom panel section.

15. The carrying case of claim 12 further comprising:

a second ear ring mounting panel secured along one edge to said primary shell on said bottom panel section, said panel having a mesh construction, and button hole slits for mounting clip style ear rings; and a pair of cover panels, each secured along one edge to said shell and securable to each other along an edge for enclosing said second ear ring mounting panel.

16. A jewelry carrying case, comprising:

a primary shell of pliable material, said shell formed of a substantially rectangular primary panel having an inner face and an outer face and foldable along a pair of lines transverse of the back panel forming a top panel section, an intermediate panel section and a bottom panel section, and wherein each panel section has a pocket assembly having at least one pocket with a transparent front panel;

a first jewelry mounting panel having a plurality of button hole slits formed therein for detachably mounting a plurality of clip style ear rings, said first mounting panel pivotally secured along one edge to said shell at the juncture of said top panel section, and said intermediate panel section;

a second ear ring mounting panel secured along one edge to said primary shell at the juncture of said intermediate panel section and said bottom panel section, said panel having a mesh construction, and button hole slits for mounting clip style ear rings; and at least a partially transparent closure panel pivotally secured along one edge to said shell at each side of each of said mounting panels for covering said mounting panel and said closure panels releasably securable along three sides over said mounting panel.

17. The carrying case of claim 16 wherein said bottom panel section comprises at least one ring mounting bar for mounting a plurality of rings on said panel section.

18. The carrying case of claim 17 wherein said intermediate panel section comprises a pocket assembly having a plurality of overlapping pockets, and a transparent cover panel for covering said pockets.

19. The carrying case of claim 16 wherein said intermediate panel section comprises a pocket assembly having a plurality of overlapping pockets, and a transparent cover panel for covering said pockets.

20. The carrying case of claim 18 wherein said top panel section comprises a pocket assembly having a plurality of pockets with a transparent cover panel, each having a zipper closure.

* * * * *